US006140587A

United States Patent [19]

Sackett

[11] Patent Number: 6,140,587

[45] Date of Patent: Oct. 31, 2000

[54] TWIN AXIAL ELECTRICAL CABLE

[75] Inventor: James A. Sackett, Houston, Tex.

[73] Assignee: Shaw Industries, Ltd., Ontario, Canada

[21] Appl. No.: 09/287,600

[22] Filed: Apr. 7, 1999

Related U.S. Application Data

[63] Continuation-in-part of application No. 08/859,129, May 20, 1997, abandoned.

[51] Int. Cl.[7] ..... H01B 11/02

[52] U.S. Cl. ..... 174/113 C; 174/116

[58] Field of Search ..... 174/113 R, 113 C, 174/113 A, 131 R, 131 A, 113 AS, 116; 385/101, 103, 105, 106, 113

[56] References Cited

U.S. PATENT DOCUMENTS

| | | |
|---|---|---|
| 3,610,814 | 10/1971 | Peacock . |
| 4,135,056 | 1/1979 | Seguin . |
| 4,174,236 | 11/1979 | Dougherty et al. . |
| 4,358,636 | 11/1982 | Ijff et al. . |
| 4,486,623 | 12/1984 | Ploppa . |
| 4,552,432 | 11/1985 | Anderson et al. . |
| 4,600,268 | 7/1986 | Spicer . |
| 4,675,475 | 6/1987 | Bortner et al. . |
| 4,816,611 | 3/1989 | Invernizzi . |
| 4,818,060 | 4/1989 | Arroyo . |
| 4,953,942 | 9/1990 | Sasaki . |
| 4,997,992 | 3/1991 | Low . |
| 5,043,530 | 8/1991 | Davies . |
| 5,120,905 | 6/1992 | Cousin et al. . |
| 5,159,157 | 10/1992 | Diegmann . |
| 5,313,020 | 5/1994 | Sackett . |
| 5,495,546 | 2/1996 | Bottoms, Jr. et al. . |
| 5,496,892 | 3/1996 | Markert et al. . |
| 5,517,591 | 5/1996 | Wagman et al. . |
| 5,574,250 | 11/1996 | Hardie et al. . |
| 5,600,097 | 2/1997 | Bleich et al. . |
| 5,699,467 | 12/1997 | Kojima et al. . |

FOREIGN PATENT DOCUMENTS

| | | | |
|---|---|---|---|
| 332406 | 11/1992 | Japan | H01B 7/04 |

*Primary Examiner*—Dean A. Reichard
*Assistant Examiner*—Chau N. Nguyen
*Attorney, Agent, or Firm*—Jennings B. Thompson; Strasburger & Price, LLP

[57] ABSTRACT

A high frequency shielded data transmission cable and method of making same are disclosed. Optimal transmission and minimal signal loss are achieved when the conductors of such a cable are maintained in fixed positions relative to one another and relative to the metal shielding. These features are provided by a cable of the instant invention wherein a central core having diametrically opposed spiral grooves hold the insulated conductors in fixed relation to one another. At least one inner layer of dielectric material maintains the insulated conductors within the grooves and provides a fixed spacing between the conductors and the metal shielding. Metal shielding, preferably of braided strips of metal, provides additional strength and flexibility to the cable. The interstitial spaces of the braid may optionally be filled with a filling compound. Likewise, the insulated conductors may be coated with a water-blocking compound to fill any spaces between the conductors and the walls of the grooves. The cable of this invention is suitable for use in harsh environments such as ocean bottom applications where it may be subjected to high pressure and substantial bending. The use of the novel central core of this cable prevents relative lateral movement of the conductors and reduces the volume of interstitial space that might otherwise collapse under such extreme conditions. In addition, a cable of this invention will allow longitudinal movement of the insulated conductors within the grooves thereby allowing the stress and compressive forces that would otherwise fatigue a cable to be relieved.

10 Claims, 4 Drawing Sheets

FIG. 4
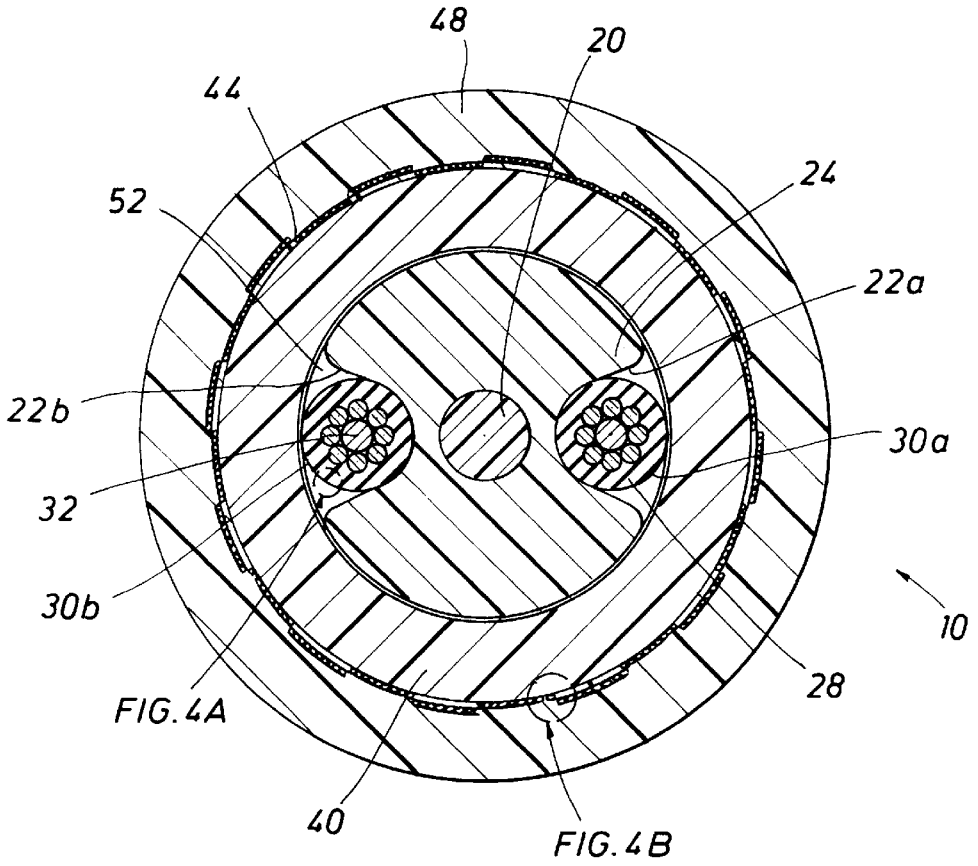
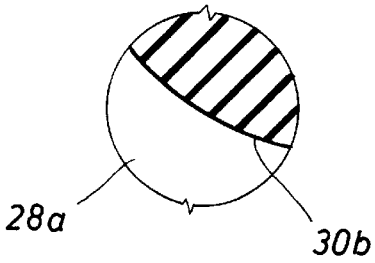
FIG. 4A
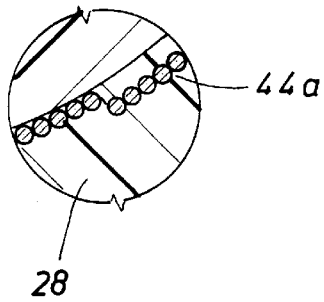
FIG. 4B

TWIN AXIAL ELECTRICAL CABLE

This is a continuation of application Ser. No. 08/859,129, filed May 20, 1997 entitled "Twin-Axial Cable" now abandoned.

BACKGROUND OF THE INVENTION

1. Field of the Invention

This invention relates to shielded electrical cables generally, and in particular to a twin-axial shielded cable for use in high frequency data transmission applications. More specifically, the twin-axial cable of this invention is intended to be utilized in harsh environments such as on the bottom of the ocean where the cable will be subjected to flexing stress due to bending along with the hydrostatic pressure of the water.

2. Description of the Prior Art

Twin-axial cable is generally formed by encasing two electric conductors, separated a predetermined distance, within a dielectric layer. The distance of separation between the two conductors is selected, in part, to prevent degradation of the electrical signal. Signal degradation occurs when there is a change in the electrical signal. The electrical characteristics that represent two forms of degradation are the "attenuation" ratio and a mismatch between the "characteristic impedance of transmission" value and the interface requirements of the mating system. Both of these characteristics can be partially controlled by the distance of separation between the two conductors. If the cable contains other conductive materials such as in the form of a metallic shield, then the distance of separation between each of the conductors and the conductive material would likewise be critical to the electrical characteristics of the cable. Therefore, it is desirable to maintain an optimum distance of separation both between the conductors and between each of the conductors and the shielding. These two separation distances directly affect the signal degradation and overall performance of a shielded twin-axial cable.

A significant problem in connection with the distances of separation between cable elements is in maintaining that separation along the entire length of the cable during manufacture of the cable. Twin conductor cables made in accordance with the prior art require a high degree of skill to ensure a desired distance of separation between the two conductors and further still, between the conductors and the shielding. Although a cable design has specific requirements, meeting those requirements is often heavily dependent on the skill level of the particular manufacturer. Another problem occurs in adjusting the separation distances of a specific design to meet varying electrical requirements. Typically, in the prior art, significant alterations to a cable design must be made to new electrical requirements. These alterations, in turn, result in significant changes in the manufacturing process.

Therefore, it is desirable when addressing conductor separation problems to decrease the skill level requirements of the manufacturer and design a cable that is easily altered to meet specific electrical needs.

In the prior art, the dielectric layer that encases the conductors serves several purposes. First, it is used to physically hold the conductors in their proper geometric configuration. Second, it serves as a protective barrier for the conductors. In certain applications, a cable may be subject to harsh chemical or physical environments, such as extreme temperatures, high pressures and corrosive conditions. Particularly in ocean bottom applications, the extreme high pressure may cause the cable to deform or possibly even collapse when the dielectric layer is not sufficiently strong to withstand the external pressures. The natural consequence of any deformation are changes in distances of separation between the cable elements. In the more extreme case where the conductors come into contact with the environment, both signal degradation and cable failure are inevitable.

A common problem with the dielectric layer arises in its capacity to act as a protective barrier. If the layer is not sufficiently thick around the conductors, cracks that form in the dielectric layer can penetrate to the conductors, exposing them to outside environments. Nevertheless, if the layer is too thick, the cable is less flexible rendering the cable inappropriate for use in many applications. Another problem that stems from encasing the conductors with the dielectric layer is the formation of interstitial spaces. If the encasing process is not properly performed, interstitial spaces often form between the insulated conductors and the dielectric layer. Formation of interstitial spaces adds to the problems associated with the formation of cracks in the dielectric layer by allowing the penetration of undesirable materials into the critical regions of the cable. Further still, in deep water applications, the presence of interstitial spaces among cable elements will increase the likelihood that the cable will collapse or otherwise deform under the extreme external pressures.

FIG. 1 depicts one type of prior art twin axial cable 36 as shown and described in U.S. Pat. No. 5,313,020. This cable consists of two insulated conductors 30, 30', twisted together, and encased in a dielectric layer 31. In forming the cable 36, the first step involves surrounding each conductor with large diameter insulation jacket 32, 32'. The thickness of the jacket is selected to be one half of the desired distance between the two conductors. The insulated conductors should be in contact with each other, not spaced apart as shown in FIG. 1, if the thickness of the jacket is ½ the spacing desired. This gap between the insulated conductors is unintentional and process dependent, but typically will be held as small as possible. Clearly, when the design spacing between the conductors is to be set only by the insulation diameter, this process variability will result in variations in the electrical performance of the cable.

Once the insulated conductors are twisted together, the conductors will be separated by at least the combined thickness of the insulation jackets around the conductors. After dielectric layer 31 is formed around the twisted, insulated conductors, metallic shield 33 is braided over the dielectric layer and outside jacket 35 is formed around the braided shield to complete the cable.

There are several disadvantages with the twin-axial cable illustrated in FIG. 1. The insulated conductors may be spaced apart so that the thickness of the dielectric at point "a" is relatively small compared to the thickness at point "b" causing the dielectric to fail at this point when the cable is bent. Further, if the insulated conductors do not remain substantially concentric with the dielectric layer 31 during manufacturing, portions of the insulated conductors in the areas where the layer's thickness is small, i.e. point "a", may not be covered at all by the layer. Depending on the skill of the manufacturer, therefore, these thin sections of dielectric layer provide, at best, only a comparatively thin barrier of protection for the insulated conductors, and at worst, provide no barrier of protection at all.

A second disadvantage with the cable of FIG. 1 also stems from the thick and thin sections of the dielectric layer 31 encasing the insulated conductors 30, 30'. Typically, the dielectric layer is formed around the insulated conductors by extrusion. The extrusion process ideally produces a tubular body of insulation that is substantially concentric with the twisted, insulated conductors. The physical design of cable 36, however, creates difficulties in achieving this goal because of the shrinkage of dielectric layer 31 during the curing and cooling of the layer. Since the wall thickness of the tubular body of dielectric material is not uniform, the shrinkage of sections of the wall of varying thickness is not uniform. Thicker sections such as that of point "b" will tend to shrink more than the thinner section of point "a". The disparity on shrinkage produces an extrusion that is not cylindrical. The non-cylindrical shape of the dielectric layer results in additional problems and expense in making and installing the braided shield 33.

The design of the cable of FIG. 1 may also result in the formation of interstitial spaces. The materials selected for dielectric layer 31 and insulation jackets 32, 32' generally do not have the same chemical base to prevent bonding so that the two layers may be separated without damaging the conductors during the process of terminating the cable. When dielectric layer 31 is extruded around the insulated conductors, the two materials will not bond due to differences in the materials. At the points where a bond does not form between the two materials, interstitial spaces form due to the shrinkage of dielectric 31. In addition, an interstitial space is formed in the gaps between the insulated conductors. These gaps are not filled due to the viscosity limited flow of dielectric 31. Alternatively, when dielectric materials are selected to insure strong bonding between these cable elements, a corresponding loss in flexibility will occur. Therefore, when a flexible cable is required, it is not desirable to bond the conductor insulation or the spacers to the dielectric material. Rather, it is preferable that the conductors not only be separated at a fixed distance from one another and from the other conductive elements of the cable, but that they be allowed to move longitudinally along the length of the cable to relieve stress and insure flexibility.

FIG. 2 depicts a second prior art method of making a twin-axial cable. This cable is FIG. 4 of my '020 patent discussed above. Cable 26 consists of two uninsulated conductors 20, 20', separated by a predetermined distance, and encased in dielectric layer 21. In forming the cable, the first step involves extruding a dielectric layer around the two uninsulated conductors. As the dielectric is extruded around the conductors, the conductors are held substantially parallel to each other at the required distance. Again, braided shield 23 of conductive material is placed around the extrusion and protective jacket 25 is extruded over the braid.

This type of twin-axial configuration has an advantage over the cable of FIG. 1 in that there are no conductor insulation jackets with which the dielectric layer material must bond. Instead, the dielectric layer bonds directly to the conductors and there is no opportunity for interstitial spaces to form around the conductors. The cost of this advantage is the loss in flexibility of the cable. The formation of a direct bond between the dielectric layer and the conductors, as the dielectric material is extruded over the uninsulated conductors, creates a bond between these cable elements over the entire length of the cable. This bonding fixes the conductors in place within the cable and prevents their longitudinal movement within the cable. This is an undesirable condition since the ability of the conductors to move longitudinally within the cable would allow them to relieve some of the tension and compression that is created when the cable is flexed.

A further disadvantage of the twin axial design shown in FIG. 2, is that the conductors are fixed in the same geometric plane for the entire length of the cable. When the cable is flexed, or bent orthogonally to the plane containing the conductors, each conductor has an equal amount of tension and compression placed upon it. However, if the cable is made to flex so that it is bent in the plane of the conductors so that the direction of the bend is coplanar with the two conductors, one of the conductors will be placed in a much higher state of tension than the other conductor. This arrangement of the conductors over the entire length of the cable render it more susceptible to fatigue stress and thus failure.

An additional disadvantage of the prior art twin axial design shown in FIG. 2 is that it is difficult to terminate the cable such as at a junction or instrument. To terminate the cable the solid extruded dielectric layer 21 must be split and removed from each conductor 20 for a sufficient length to allow the conductor to be attached to the instrument. Removal of the extruded solid dielectric layer is difficult and greatly hampers this procedure.

FIG. 3 depicts yet a third type of prior art twin-axial cable that overcomes some of the conductor spacing concerns noted above. Illustrated in FIG. 3 is cable 10, having central core 11 about which a pair of insulated conductors 12, 12' are helically wrapped along with a plurality of spacers 14 used to maintain the insulated conductors in fixed relative positions. A layer 15 of dielectric material encases the core, conductors and spacers. A braid 16 of metallic wire is placed over the dielectric layer 15 and the cable is completed with an outer jacket 17 of dielectric material.

The design of the twin-axial cable in FIG. 3 provides proper spacing of the conductors within the cable and maintains them in fixed relative positions. This cable is the subject of the '020 patent. The means by which this spacing is accomplished in this cable creates unavoidable interstitial spaces. In particular, the use of spacers 14 to insure proper spacing of the conductors creates voids 19 between the conductors, spacers, and core that may not be filled by the extruded dielectric material. The presence of such interstitial spaces may allow the cable to deform and possibly even collapse under the high pressure conditions present in deep water applications. Naturally, any deformation or collapse of the cable structure will change the spacing between the cable elements altering its electrical characteristics.

An additional disadvantage of the twin-axial cable design shown in FIG. 3 is again one of manufacturing. The level of skill required to insure a uniform product over the length of cable 10 is relatively high due to the problems of interstitial spaces and voids in the dielectric layer. Re-configuring the cable design for different electronic specifications would also be an involved process requiring the alteration of multiple cable elements.

Therefore, it is an object and feature of this invention to provide a twin-axial cable that has a substantially solid core to support the conductors, to maintain those conductors in relatively fixed lateral positions, and to reduce the likelihood of interstitial spaces and voids forming between cable elements. Specifically, the cable of the present invention comprises a central core that is relatively rigid and non-compressible, and an outer core of a flexible polymeric material that surrounds the inner core and is provided with diametrically opposed grooves in which insulated conductors are positioned.

It is another object and feature of the present invention to maintain the insulated conductors in laterally fixed, spaced, relationship within the cable. This feature is achieved in the present invention by holding the conductors in engagement with the bottoms of the grooves formed in the outer core by a layer of dielectric tape wrapped around the outer core along with an annular body of uniform thickness of dielectric material extruded around the dielectric tape.

It is a further feature of the present invention to provide a twin axial cable design that allows each insulated conductor to move longitudinally within the cable independent of the other insulated conductor. This feature is achieved by holding the insulated conductors in the grooves in the outer core by the dielectric tape that separates the conductors from an outer annular body of dielectric material to which the conductor insulation might otherwise bond during cable manufacturing. A water-blocking compound may optionally be employed to fill any interstitial spaces between the insulated conductors and the walls of the grooves. If used, this compound should be of such a nature that it allows the conductors to move longitudinally within the grooves.

It is a further feature of the present invention to provide a shielded twin-axial cable in which an annular layer of metallic highly conductive material surrounds the annular body of dielectric material that surrounds the dielectric tape, the conductors and the core, thereby providing a fixed distance of separation between the conductors and the shielding. Because the cable of the present invention is intended for deep water applications, the strength of the dielectric layer and its ability to withstand the high external pressures without deformation are critical. The annular shield is typically metal wire braided about the dielectric layer. A filling compound can be used to fill interstitial spaces that may exist in the shield.

It is a yet another feature of the present invention to provide a twin-axial cable that is durable and less susceptible to fatigue stress due to excessive bending and flexing. This feature is achieved through the selection of cable materials, by enabling the conductors to move longitudinally within the cable and by arranging the conductors within the cable so that an applied stress may be more readily relieved. Each conductor is held in one of two separate diametrically opposed, longitudinally extending helical grooves in the central core. This arrangement of the conductors allows for an improved distribution of the tensile and compressive stresses that are created in the conductors as the cable is flexed.

These and other objects, advantages, and features of this invention will be apparent to those skilled in the art from a consideration of this specification including the attached drawings and appended claims.

In the Drawings:

FIG. 4 is a cross-sectional view of the preferred embodiment of the present invention showing a solid central core, an outer core with grooves formed therein, a layer of dielectric tape to maintain the conductors within the grooves and outer layers of as dielectric material on either side of a metallic shield.

FIG. 4A is a view on an enlarged scale of the water-blocking compound 28*a* between the conductors and the walls of the groove 22*b*.

FIG. 4B is a view on an enlarged scale of a portion of metal shield 44 and filling compound 44*a*.

DESCRIPTION OF THE PREFERRED EMBODIMENTS

Figure 1:
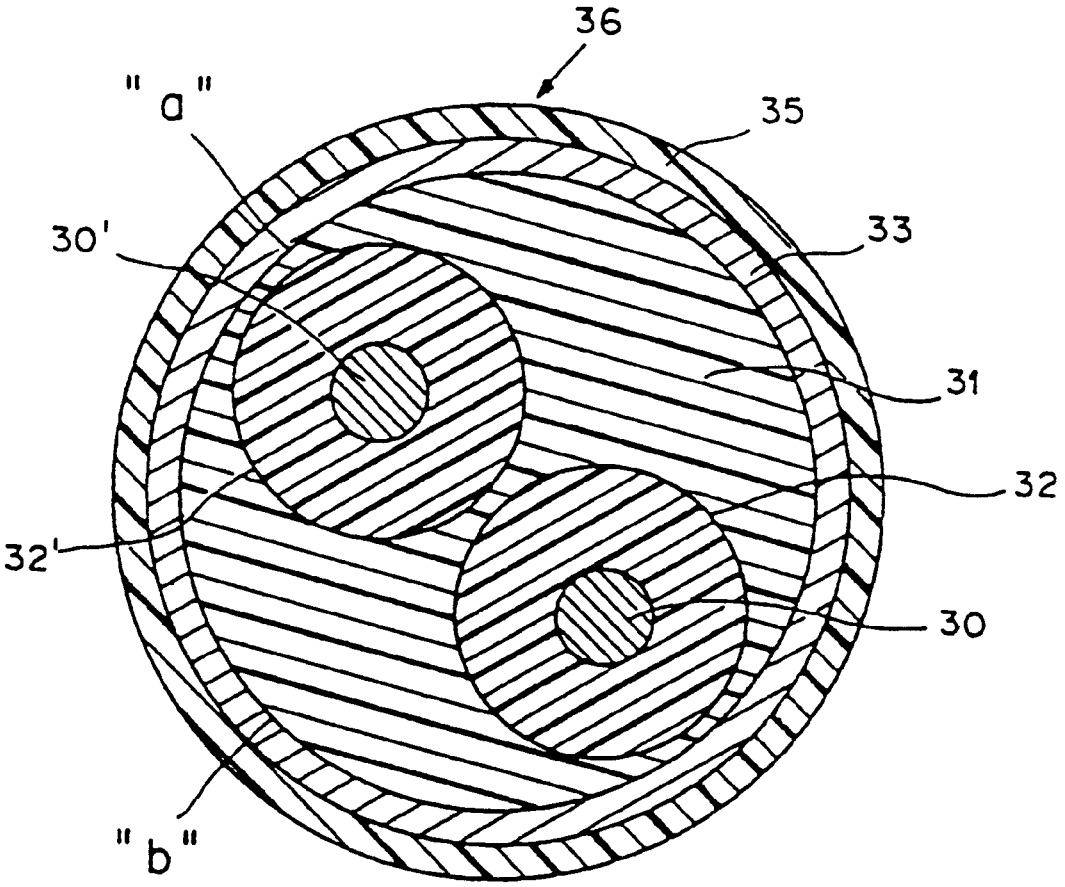
PRIOR ART FIG. 1
FIG. 1 is cross sectional view of a prior art twin axial cable having a pair of insulated conductors and a non-uniform layer of dielectric material about the conductors.

FIG. 4 is a cross-section of high frequency data transmission cable 10 having a central core 20 and an outer core 24 that has at least one pair of diametrically opposed helical grooves 22*a* and 22*b* formed therein. Positioned in each groove 22 to follow the helix of each groove are electrical cables 30*a* and 30*b*. Each cable comprises conductors 32 and insulation 28. Helical grooves 22*a* and 22*b* have semi-circular bottoms that mate with a portion of the circular outer surface of cables 30*a* and 30*b* to hold the cables equally spaced from the center of the cable and directly opposite the central core. The grooves have side walls that flare outwardly from the semi-circular bottoms of the grooves so that there is sufficient contact between the cables and the bottom of the grooves to hold the cables in the desired position with a minimum of contact with the walls of the grooves. Dielectric tape 36 holds the cables in the grooves with a minimum resistance to the longitudinal movement of the cables. This allows the cable to readily bend with the parent cable in which it is located and to move longitudinally relative to the grooves.

Wrapped around the outer core 24 and cables 30*a* and 30*b* is a layer of dielectric tape 36 that holds the cables in engagement with the bottom of the grooves and prevents insulation 28 of the conductors from bonding to first dielectric layer 40 that surrounds the outer core 24. Around first dielectric layer 40 is braided metal shield 44 that is overlain by outer jacket 48. Optionally, conductor insulation 28 may be coated with a water-blocking compound 28*a* (not shown) to fill any interstitial spaces 52 that may form between the insulated conductors, the walls of grooves 22, and dielectric tape 36. In addition, shield 44 may be coated with a filling compound 44*a* (not shown) to fill any interstitial spaces in the braided metal.

More specifically, central core 20 is relatively stiff and non-compressible. The central core provides spacing between the conductors and rigidity to outer core 24 thereby lending radial support to the outer core in separating the conductors and maintaining them in fixed relative positions. Central core 20 is preferably made from a high density polyethylene or Teflon® or a polymer composite matrix containing Kevlar® or some other strength enhancing, non-conductive material. Although structural in character, it is preferable that central core 20 not contain metallic elements that might otherwise interfere with the electrical signal of cable 10. Central core 20 may be formed through a variety of processing techniques such as extrusion, pultrusion or filament winding.

Outer core 24 is a softer polymeric material than central core 20 and is preferably a thermoplastic rubber that is extruded over the central core. During manufacture, the outer core is preferably extruded with grooves 22*a* and 22*b* on opposite sides that extend straight along the length of the outer core. Grooves 22*a* and 22*b* may be of any shape that will contain the insulated conductors when laid therein, however, to minimize the locations where voids and interstices may occur, it is preferable to extrude the outer core with semi-circular grooves or grooves that will otherwise conform to the outer surface of the insulated conductors. Furthermore, the size of the grooves should also be selected so that there is minimal space between the insulated conductors and the walls of the grooves to allow the conductor to move longitudinally relative to the grooves as explained above. Grooves 22*a* and 22*b* should be substantially 180° apart in their physical relation on the periphery of the outer core. Outer core is then twisted during the cabling process to create the helical arrangement of grooves 22*a* and 22*b* around the central core.

Figure 2:
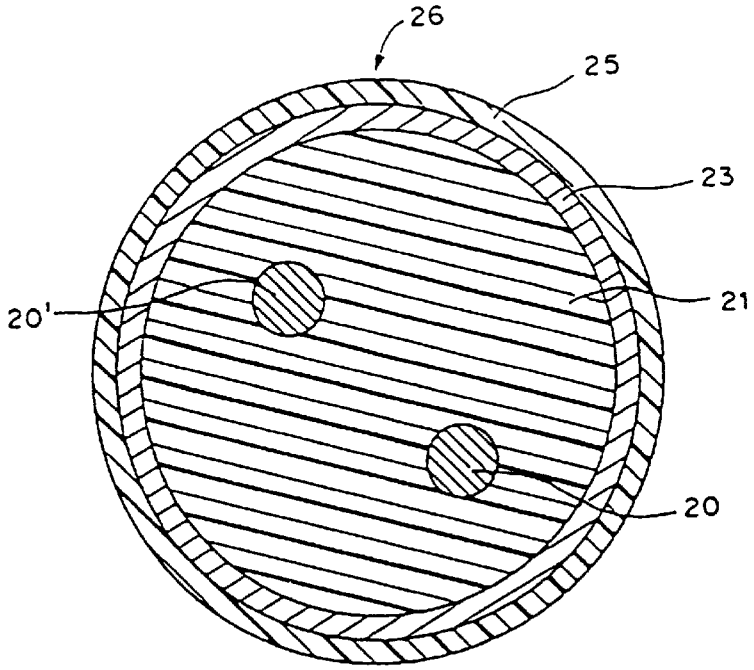
FIG. 2 PRIOR ART
FIG. 2 is cross sectional view of a prior art twin axial cable having a pair of uninsulated conductors encased in a thick dielectric layer forming a relatively stiff rigid cable.

The central and outer cores, 20 and 24, provide the necessary distance between the insulated conductors to achieve the desired electrical requirements. They also render the separation of the conductors during manufacture less skill dependent than either of the cables of FIGS. 1, 2 or 3. In the present invention, the thickness of the conductor insulation 28 need not be changed to meet the electrical requirements of a specific cable since the central and outer cores are the cable elements that determine the distance of separation between the conductors. Thus, the same insulated conductor wire can be used in cables with varying electrical requirements.

To insure that the central elements form a cylindrical shape on which the first dielectric layer and outer jacket may be extruded, insulation 28 of the conductors may be coated with a water-blocking or cable filling compound. For instance, to prevent the formation of interstitial spaces between the insulated conductor 30 and the walls of groove 22, space 52 will be filled by the compound during cabling. Further, the compound selected should allow the insulated conductors 30*a* and 30*b* to move relatively freely longitudinally within grooves 22*a* and 22*b*, respectively. The compound may be any water blocking compound known in the art having the desired characteristics such as the dimethyl polysiloxane grease available from Dow Corning under the trade designation DC-111.

In addition, a thin layer of dielectric material 36 is applied over the central and outer cores and the insulated conductors to insure the uniformity of the cable shape. This thin layer is preferably a layer of dielectric tape that is wrapped around the cable's central elements. Tape 36 is preferably a heat sealable polyester, such as Mylar coated on one side with a heat activated adhesive, reinforced with fiber. As noted above, the function of the dielectric tape 36 is twofold. First, the tape is used to hold insulated conductors 30*a* and 30*b* in place within their respective grooves. Secondly, tape 36 is intended to inhibit and possibly prevent conductor insulation 28 from bonding to first dielectric layer 40 which may occur as that layer is extruded over the insulated conductors.

The combination of the water blocking compound and the dielectric tape insures that (1) the central elements of the cable are uniformly cylindrical, (2) that the insulated conductors are held in fixed relative positions without the possibility of lateral movement and (3) that the conductors are relatively free to move longitudinally within the grooves along the cable's length.

Figure 3:
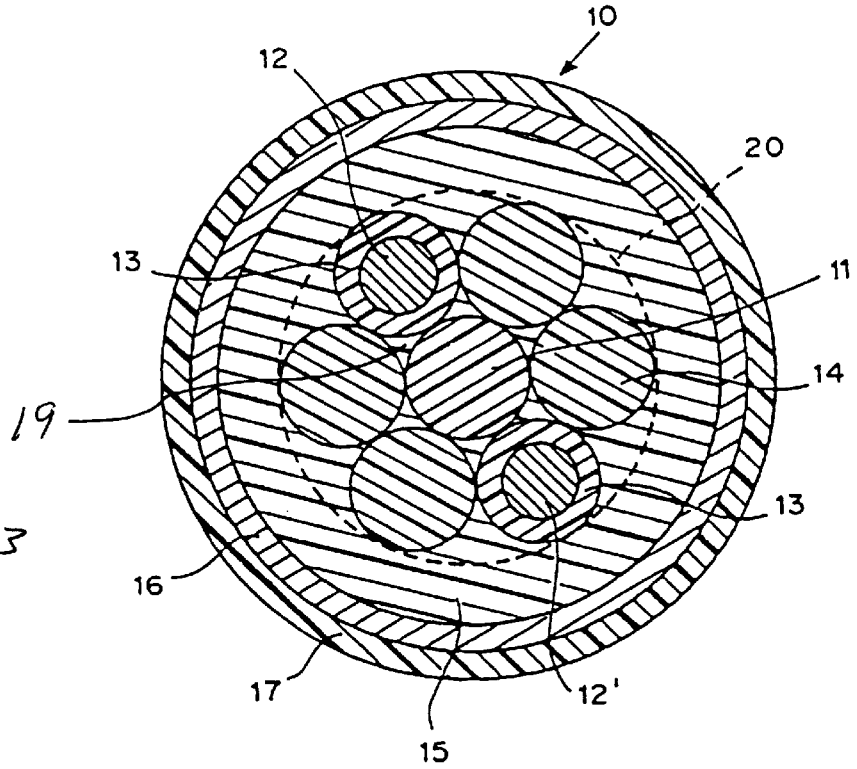
FIG. 3 PRIOR ART
FIG. 3 is cross sectional view of a prior art design of a twin axial cable having a pair of insulated conductors that are maintained in their relative positions by a plurality of spacers around a solid core.

The skill requirements for manufacturing a cable of the present invention are reduced over those required of the design in FIG. 3. Specifically, because the core elements of the present invention provide a relatively uniform cylindrical base over which the first dielectric layer and outer jacket may be extruded, there is less disparity in material shrinkage. Since shrinkage of dielectric materials depends on the material's thickness, it is desirable to maintain a uniform thickness around the central elements. The presence of the central and outer cores and the insulated conductors creates a uniformly cylindrical base on which the dielectric layers may be extruded, resulting in more uniform shrinkage. Naturally, the more uniform the shrinkage, the more uniform and symmetrical the cable. The skill requirements for producing a cable of the present invention are further reduced by the substantially solid nature of the central and outer cores as there are fewer locations where interstices and voids may form among the cable elements.

First dielectric layer 40 provides the spacing between insulated conductors 30*a* and 30*b* and shield 44. First dielectric layer 40 should be sufficiently strong to maintain a selected distance of separation between these conductive materials when cable 10 is subjected to anticipated external pressures. First dielectric layer 40 is preferably a high density polyethylene that is extruded over the thin layer of dielectric tape 36. The primary functions of first dielectric layer 40 are to provide radial support to shield 44 and to assist dielectric tape 36 in holding the insulated conductors within grooves 22*a* and 22*b*. In addition, dielectric layer 40 acts as a continuous, thick walled barrier between the outside of the cable 10 and the critical central elements.

Shield 44 is placed around the first dielectric layer to protect and to provide a predictable ground plane to tune the high frequency transmission characteristics the internal components' electrical environment from external electrical influences. The shield is applied using techniques known in the art and is preferably metal wire braided around first dielectric layer 40. More particularly, shield 44 may be made of a copper containing a tinning compound, a silvered metal, or any other metal that is not readily susceptible to corrosion and oxidation and that is highly conductive having low signal loss characteristics. Further, metal braid 44 may be coated with a cable filling compound to lubricate and fill the interstices of the braided metal as well as to prevent the oxidation of the braided metal. Alternatively, an extrusion of an electrically conductive polymer may be utilized to bond the shield to the first dielectric layer 40 and fill the gaps in the braided shield.

The outer jacket 48 is a second annular layer of dielectric material that is extruded over shield 44. Jacket 48 may be most any polymeric material that is of a good jacketing grade polymer, selected for the anticipated conditions of the particular cable application. For deep water and ocean bottom applications, it is preferable that jacket 48 be a polyethylene although polyurethane, polypropylene, neoprene, thermoplastic rubbers and various polymer composite matrices may also be appropriate.

The cable of the present invention can easily be altered before manufacturing to yield desired mechanical and electrical characteristics. The design can be "tuned" electrically by (1) altering the distances of separation between the conductors and between the conductors and the shield, (2) altering the materials of the central and outer cores, (3) altering the materials of the first and second dielectric layers and (4) altering the materials and the conductivity of the conductors and/or metal shield. By regulating the diameter of the core for example, a cable can be designed to yield a desired characteristic impedance of transmission. Proper choice of materials for the central and outer cores and the dielectric layers allows the E field to be shaped as desired based on the dielectric constants of the material. For example, the internal components could be a high density solid polyethylene to reduce the characteristic impedance of transmission, or a foamed polyethylene for increased characteristic impedance of transmission. When selecting the materials necessary to produce the desired characteristics of cable 10, it is advantageous to select materials with a common chemical base, such as polyethylene. This ensures adequate bonding between component parts and decreases the formation of interstices. As illustrated by the above examples, a material can have the same common chemical base, e.g., polyethylene, while different members within the chemical family can display a wide range of electrical and mechanical properties.

The cable design may also be "tuned" mechanically by choice of materials for the central and outer cores. For example, central core 20 could be a high density solid polyethylene for maximum crush resistance, or a foamed polyethylene for lower weight. Thus, by simply varying the type of material used to form the central and outer cores, different mechanical properties can be achieved without varying the overall diameter of the cable.

Figure 5:
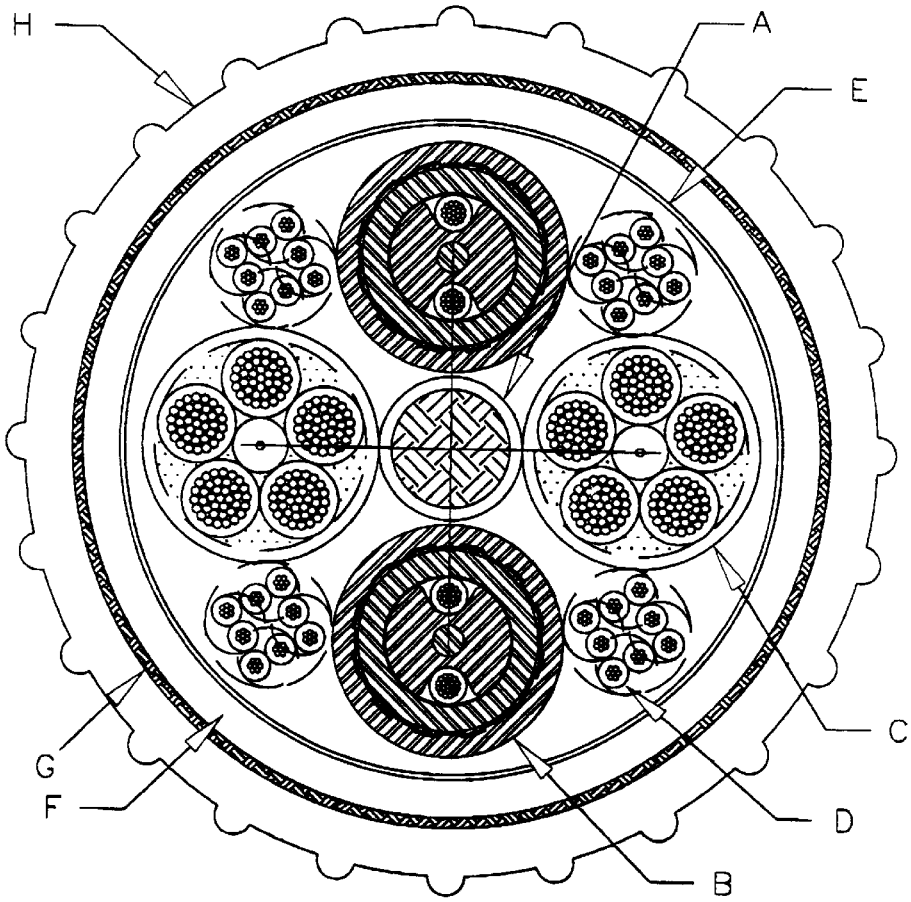
FIG. 5 is a cross-section of a typical ocean bottom cable that employs twin-axial cables to transmit hydophone or other sensor signals to the recording equipment on the boat towing the cable.

One of the uses of the high frequency data transmission cables of this invention is as part of a streamer cable with distributed electronic modules to transmit signals collected from hydrophones to secondary equipment on the boat to which the main cable is connected. A related use is in "ocean bottom cable" that also transmits signals from assorted sensors back to a recording vessel. A cross section of such a cable is shown in FIG. 5.

The cable includes central stress cable A, which is the load bearing member of the cable. A pair of high frequency data transmission cables B are positioned on opposite sets of the central stress cable A. Bundles of power transmitting wires C are positioned on opposites sides of the stress core. Small sensor wires D are arranged in bundles inside tape E that encores the entire bundle to hold each component in its positions shown. Jacket F, that includes Kevlar reinforcing G, combines with outer jacket H to enclose the cable.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

I claim:

1. An electrical high frequency data transmission cable for use in an adverse environment, comprising:

an extruded central core of a stiff, non-compressible polymeric material, an extruded outer core covering the central core and having two diametrically opposed helical grooves, each having a semi-circular bottom and side walls that diverge outwardly from the bottom of the groove, two insulated electrical conductors each of which being positioned in one of the helical grooves so that the conductors are substantially diametrically opposed and equally spaced from each other along the length of the outer core and each conductor is free to move longitudinally independent of the other, an extruded first tube of dielectric material covering the outer core and the insulated conductors, a shield of highly conductive material encasing the first dielectric layer to shield the insulated conductors from external electrical influences and tune the electrical characteristics of the cable, and an extruded jacket of dielectric material encasing the shield.

2. The high frequency data transmission cable of claim 1, further including a second, thin dielectric layer between the outer core and conductors and the first dielectric layer.

3. The high frequency data transmission cable of claim 2, wherein the second layer of dielectric material is a layer of dielectric tape.

4. The high frequency data transmission cable of claim 1, wherein the first dielectric layer is a high density polyethylene.

5. The high frequency data transmission cable of claim 1, wherein the jacket is a polymeric material selected from the group of polyethylene, polyurethane, polypropylene, neoprene, and thermoplastic rubbers.

6. The high frequency data transmission cable of claim 1, wherein the central core is a solid high density polyethylene.

7. The high frequency data transmission cable of claim 1, wherein the outer core is a thermoplastic rubber.

8. The high frequency data transmission cable of claim 1, wherein the shield of highly conductive material is a metal braid.

9. The high frequency data transmission cable of claim 1, further comprising a filling compound in interstitial spaces of the metal braid.

10. The high frequency data transmission cable of claim 1, further comprising a water-blocking compound between the conductors and the walls of the grooves.

* * * * *